US007080997B2

(12) United States Patent
Matsuo

(10) Patent No.: US 7,080,997 B2
(45) Date of Patent: Jul. 25, 2006

(54) COAXIAL CONNECTOR HAVING A SWITCH

(75) Inventor: Yasuhiro Matsuo, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 67 days.

(21) Appl. No.: 11/201,095

(22) Filed: Aug. 11, 2005

(65) Prior Publication Data

US 2006/0046547 A1 Mar. 2, 2006

(30) Foreign Application Priority Data

Aug. 27, 2004 (JP) ..... 2004-248735

(51) Int. Cl.
*H01R 29/00* (2006.01)

(52) U.S. Cl. ..... 439/188; 200/51.1

(58) Field of Classification Search ..... 439/188, 439/944

See application file for complete search history.

(56) References Cited

U.S. PATENT DOCUMENTS 6,473,045 B1 * 10/2002 Duquerroy et al. ..... 343/702
6,574,855 B1 * 6/2003 Hida ..... 29/622
6,659,784 B1 * 12/2003 Klein et al. ..... 439/188
2004/0206614 A1 * 10/2004 Fukuzaki et al. ..... 200/51.09
2005/0048823 A1 * 3/2005 Barlerin et al. ..... 439/188

FOREIGN PATENT DOCUMENTS

JP 2000-113948 4/2000

* cited by examiner

*Primary Examiner*—James R. Harvey
(74) *Attorney, Agent, or Firm*—Takeuchi&Kubotera, LLP

(57) ABSTRACT

The coaxial connector having a switch includes a switching spring and a connecting plate, which composes a pair of switching means as a switching mechanism arranged in the hollow portion of the insulating housing. The switching spring and the connecting plate extend along the inserting/removing direction of the counter pin into/from the hollow portion, and have shapes so as to face each other in the hollow portion. The switching spring is comprised of a securing section for securing to the insulating housing and a generally S-shaped elastic arm, which is comprised of a generally U-shaped first elastic arm, which extends from the securing section into the hollow portion, and a generally inverted U-shaped second elastic arm that extends from the first elastic arm. The second elastic arm has a contact section, which contacts with the connecting plate when the counter pin is not inserted in the hollow portion, and another contact section, which contacts with the counter pin when the counter pin is inserted in the hollow portion.

9 Claims, 9 Drawing Sheets

COAXIAL CONNECTOR HAVING A SWITCH

BACKGROUND OF THE INVENTION

1. Field of the Invention

The present invention relates to a coaxial connector having a switch.

2. Background Technology

A coaxial connector having a switch generally includes a hollow insulating housing, a switching mechanism comprised of a pair of switching means, and an outer conductor that is provided outside of the insulating housing and coaxially surrounds the center inner conductor. The switching means are respectively provided in the hollow portion of the insulating housing. Once a pin of the counter connector (hereinafter referred to as "counter pin") is received in the hollow portion, only one of the switching means is connected to the counter pin, and the contact points are separated and the connection of the center inner conductor is switched.

As an example of the use of this type of coaxial connector having a switch, it can be used for switching between antennas. For example, an open coaxial connector having a switch can be attached on a surface of the cellular phone, and by disposing the cellular phone at a specified place in a vehicle, active antenna can be easily switched from the built-in antenna in the cellular phone to the outer antenna of the vehicle. More specifically, while the built-in antenna of the cellular phone is used during normal use of the cellular phone, when the cellular phone is used in the vehicle, the antenna of the cellular phone is switched from the built-in antenna to the outer antenna of the vehicle by connecting the coaxial connector having a switch in the cellular phone to a connector for connecting to the outer antenna of the vehicle, which is disposed in a specified place in the vehicle.

As a conventionally known coaxial connector having a switch, the one disclosed in Unexamined Japan Patent Application Publication 2000-113948 can be listed. In this well-known coaxial connector having a switch, the insulating housing is divided into two housing parts, which compose an insulating housing by attaching to each other. A pair of switching means is provided on respective housing parts. By attaching the two housing parts to each other, the coaxial connector having a switch is connected and assembled.

According to this well-known coaxial connector having a switch, assembly can be simplified, required time for assembly can be reduced, and cost can be reduced. In addition, there are many other effects, such as improvement in the switching mechanism of the coaxial connector having a switch.

Patent Reference 1: Unexamined Patent Application Publication 2000-113948.

The above-described conventional coaxial connector having a switch, however, has the following problems. That is, in this well-known coaxial connector having a switch, a switching spring and a connecting plate, a pair of switching means that composes the switching mechanism, are arranged generally parallel to each other.

There becomes a high demand of reducing the size of this type of coaxial connector having a switch. If the size of the connector is reduced more, the actual dimension between the switching spring and the connecting plate has to be narrower. Therefore, by reducing the size of this well-known coaxial connector having a switch, electric characteristics such as isolation characteristics may become poor.

SUMMARY OF THE INVENTION

Accordingly, it is an object of the invention to provide a coaxial connector having a switch that can solve the above problems.

According to one view of the invention, the coaxial connector having a switch includes: an insulating housing, which has an opening and a hollow portion to receive a counter pin; a switching mechanism, which is comprised of a pair of switching means, is provided in the insulating housing and can work as a center conductor according to the operation with the counter pin; and an outer conductor, which is provided so as to surround the outer perimeter of the insulating housing. The pair of switching means is comprised of a switching spring and a connecting plate, which respectively extend as a whole along the inserting/removing direction of the counter pin to/from the opening and the hollow portion, and have shapes so as to generally face each other in the hollow portion. The switching spring is comprised of a securing section for securing to the insulating housing, and an elastic arm that has a generally S-shape as a whole. The elastic arm is comprised of a first elastic arm that extends from the securing section into the hollow portion and has generally U-shape, and a second elastic arm that extends from the first elastic arm and has a generally inverted U-shape. The second elastic arm has a contact section, which contacts with the connecting plate when the counter pin is not inserted in the hollow portion, and another contact section, which contacts with the counter pin when the contact pin is inserted in the hollow portion.

According to one embodiment of this invention, the first elastic arm extends from a part of the securing section, which is near the mounting board.

According to another embodiment, the first elastic arm extends from a part of the securing section, which is near opposite end to the board.

According to still another embodiment, the connecting plate has a generally flat shape, and has a contact section for contacting with the switching spring. The contact section of the connecting plate is arranged off in relative to the arrangement of the securing section.

According to yet another embodiment, the outer conductor is comprised of a metallic case, which includes an upper surrounding part to surround the insulating housing, and a lower connecting part that is connected to the upper surrounding part. The lower connecting part has a brim, which covers the connecting section of the switching spring and the connecting section of the connecting plate, which connects to the center conductor of the board.

According to still yet another embodiment, the insulating housing is formed as a one-piece component.

According to still yet another embodiment, the insulating housing is divided into two parts, a first insulating housing part and a second insulating housing part, and is formed by attaching those parts to each other.

According to another view of the invention, the coaxial connector having a switch is comprised of: an insulating housing that has an opening and a hollow portion to receive the counter pin; a switching mechanism that is arranged in the insulating housing, can work as a center conductor according to the operation with the counter pin and is comprised of a pair of switching means; and an outer conductor, which is provided so as to surround the outer circumferential portion of the insulating housing. The pair of switching means is comprised of a switching spring and a connecting plate, which extend as a whole along the inserting/removing direction of the counter pin into/from the opening and hollow portion, and have shapes so as to generally face each other in the hollow portion. The switching spring has a securing section for securing to the insulating housing, and an elastic arm that extends from the securing section into the hollow portion. The elastic arm has a contact section, which contacts with the connecting plate when the counter pin is not inserted in the hollow portion, and another contact section, which contacts with the counter pin when the counter pin is inserted in the hollow portion. The outer conductor is comprised of a metallic case, which includes an upper surrounding part that surrounds the insulating housing, and a lower connecting part that is connected to the upper surrounding part. The lower connecting section has a brim, which covers the connecting section of the switching spring and the connecting section of the connecting plate, which connect to the center conductor of the board.

BRIEF DESCRIPTION OF THE DRAWINGS

FIG. 6 is an exploded cross-sectional view of the first insulating housing part of the coaxial connector having a switch of FIG. 1 when the switching spring attached in.

FIG. 7 is a front view of the first insulating housing part of the coaxial connector having a switch of FIG. 1 when the switching spring is attached in.

FIG. 8 is a cross-sectional view of the first insulating housing part the coaxial connector having a switch of FIG. 1 when the switching spring is about to be inserted in.

FIG. 9 is an exploded cross-sectional view of the second insulating housing part of the coaxial connector having a switch of FIG. 1 when the connecting plate is attached in.

FIG. 10 is a front view of the second insulating housing part of the coaxial connector having a switch of FIG. 1 when the connecting plate is attached in.

FIG. 11 is a cross-sectional view of the second insulating housing part of the coaxial connector having a switch of FIG. 1 when the connecting plate is about to be inserted in.

BEST MODE TO CARRY OUT THE INVENTION

Embodiments of this invention will now be further described with reference to the accompanying drawings.

Figure 1:
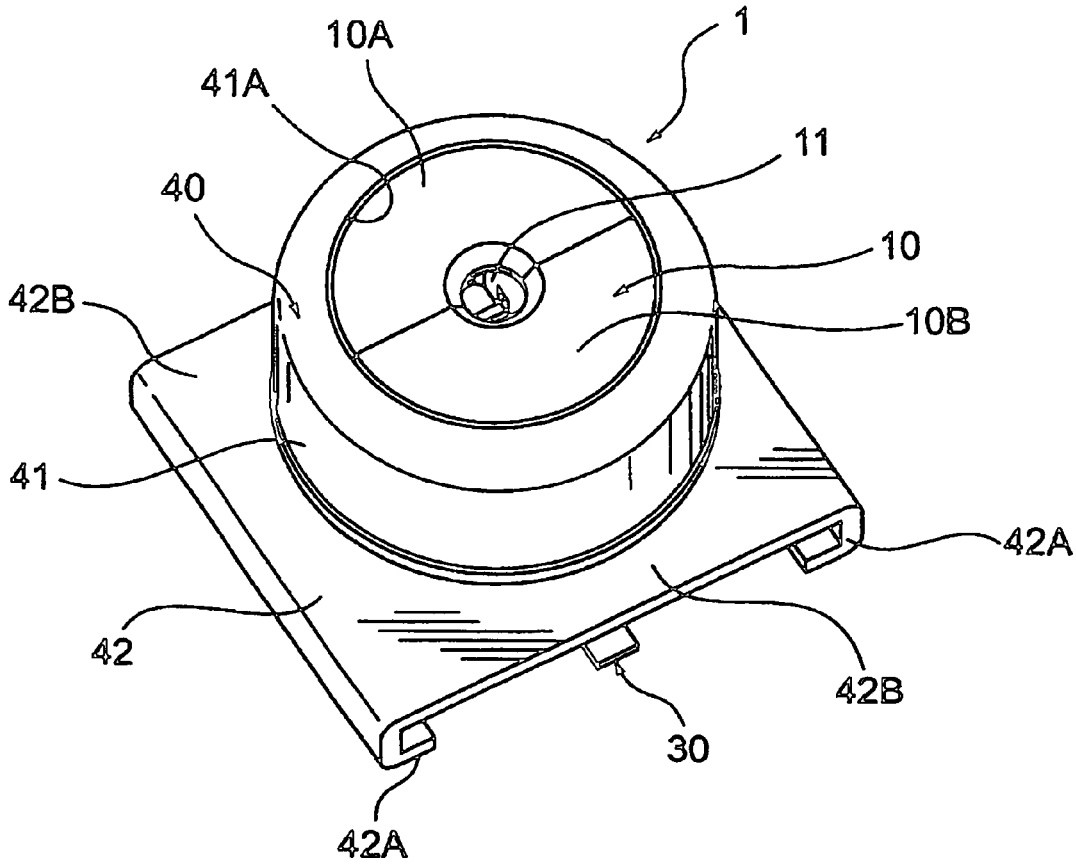
FIG. 1 is an upper perspective view of the coaxial connector having a switch as an embodiment of this invention.
Figure 2:
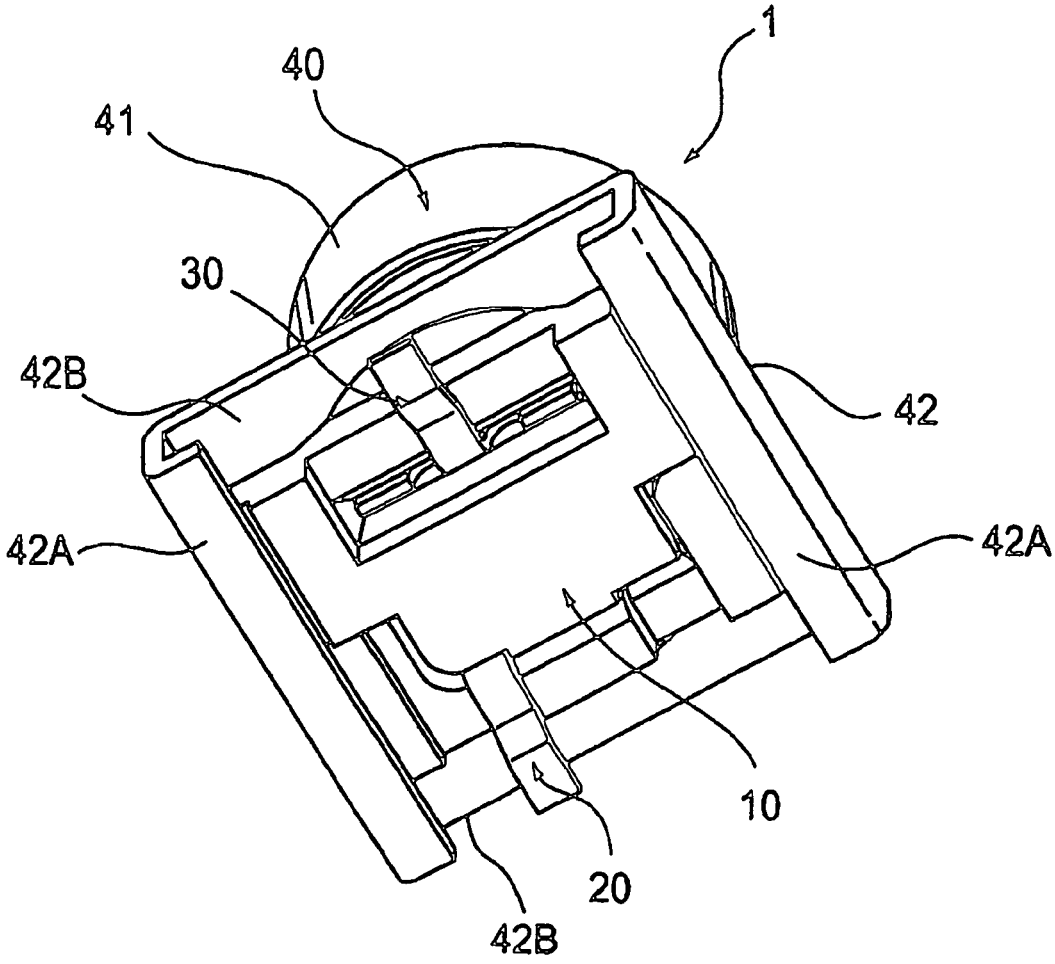
FIG. 2 is a lower perspective view of the coaxial connector having a switch of FIG. 1.
Figure 3:
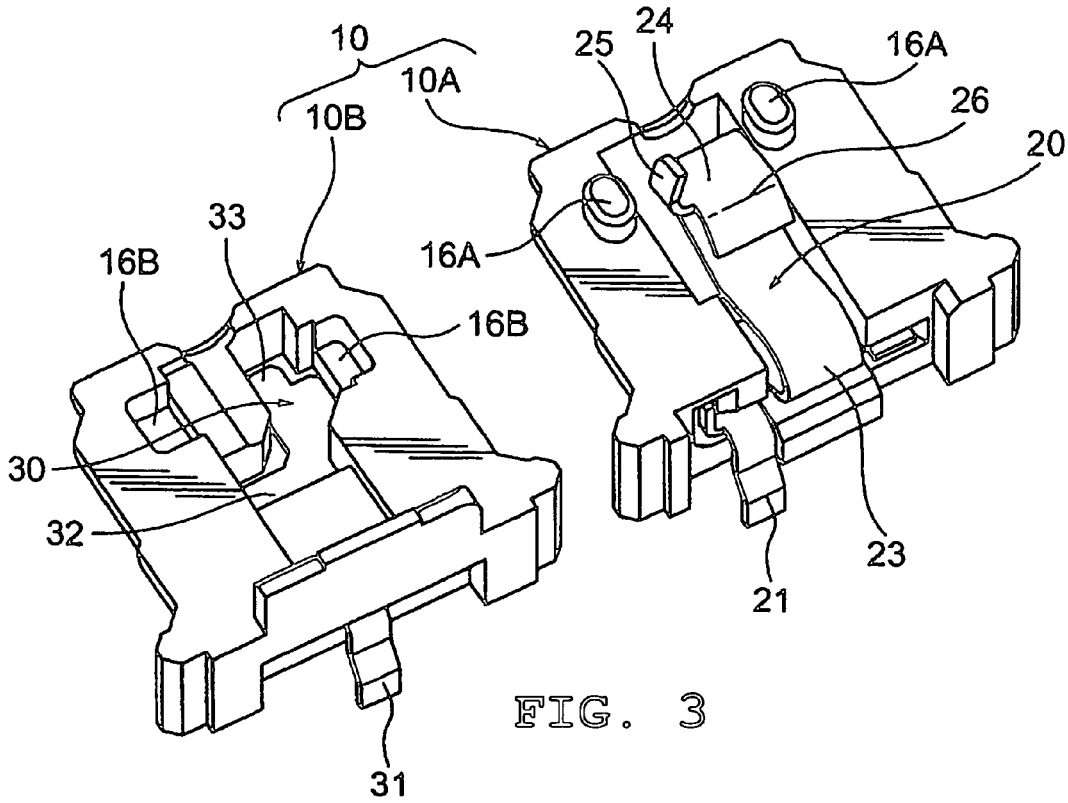
FIG. 3 is a perspective view of the two separate insulating housing parts of the coaxial connector having a switch of FIG. 1 before attaching to each other and before being covered with the metallic case.

As shown in FIGS. 1–3, the coaxial connector 1 having a switch is comprised of a cylindrical insulating housing 1, a pair of switching means, which is comprised of a switching spring 20 and a connecting plate 30 and forms a switching mechanism to be disposed in the insulating housing 10, and a metallic case 40 to surround the insulating housing 10. The outer diameter of the cylindrical portion of the metallic case 40 is set 2.8 mm.

In this embodiment, as fully illustrated in FIG. 3, the insulating housing 10 is divided into two separate parts, and consists of a first insulating housing part 10A and a second insulating housing part 10B. The switching spring 20 and the connecting plate 30 are respectively attached to the housing parts. When those insulating housing parts are attached to each other to form a coaxial connector, they also work as a center conductor in the coaxial connector. Here, the switching spring 20 is preferably made by punching and bending a conductive metallic sheet that has spring-like characteristics. On the other hand, the metallic case 40 works as an outer conductor that coaxially surrounds the central conductor in the coaxial connector, and also works to reinforce the attachment of the two insulating housing parts, i.e. the first and the second insulating housing parts 10A and 10B.

Referring now to FIGS. 4–11, detailed structures, functions and operations of respective components of the coaxial connector having a switch according to this embodiment will be described below.

Figure 4:
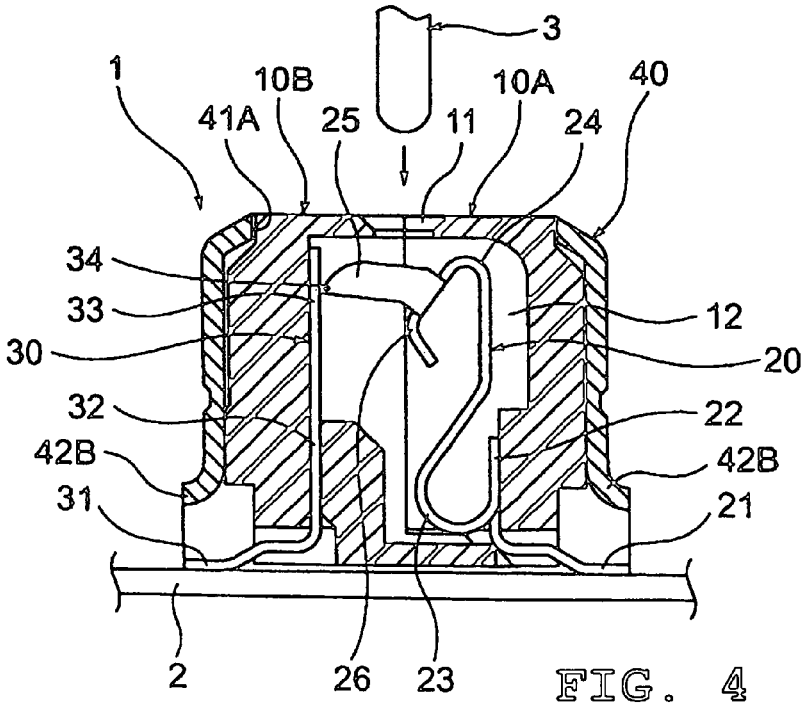
FIG. 4 is an exploded cross-sectional view of the coaxial connector having a switch of FIG. 1, which is mounted on a board.
Figure 5:
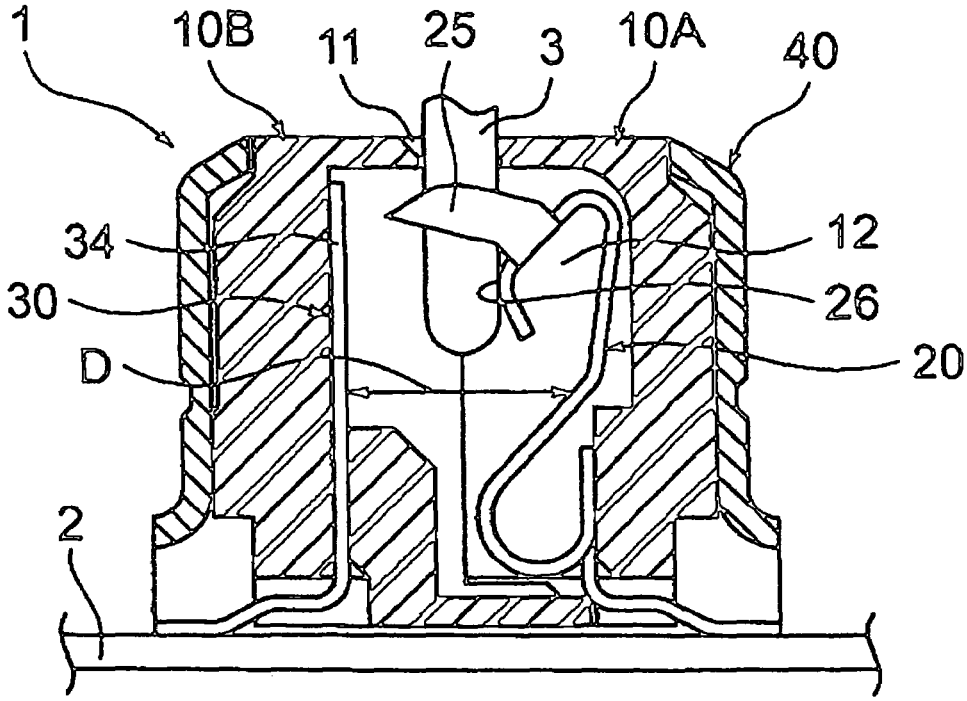
FIG. 5 is an exploded cross-sectional view similar to FIG. 4, but the counter pin being fitted therein.

FIGS. 4 and 5 show the coaxial connector 1 having a switch of FIG. 1, which is mounted on a mounting board, such as a printed circuit board. Those figures are exploded cross-sectional views for easy understanding of the arrangement of the switching spring 20 and the connecting plate 30, which face each other. In FIG. 4, the counter pin 3 is not inserted, while it is inserted in FIG. 5. As fully shown in FIGS. 4 and 5, as for the shapes of the first and the second insulating housing parts 10A and 10B, by attaching the first insulating housing part 10A to the second insulating housing part 10B as described below, the insulating housing 10 will have an opening 11 in the center portion on the top for inserting/removing the counter pin 3, and a hollow part 12 inside so as to receive the counter pin 3 and allow the movement of the switching spring 20 for switching.

The switching spring 20, which is pressed in and attached to the first insulating housing 10A as described below, includes: a connecting section 21 that is connected and secured to corresponding center conductor provided on the board 2 by soldering or by other method; a press-in securing section 22 that connects to the connecting section 21 and are pressed in and secured to corresponding press-in groove 11A (See FIGS. 7 and 8) of the first insulating housing part 10A; a first elastic arm 23, which extends downward and forward from the lower end of the press-in securing section 22 and then is curved upward and backward so as to have generally U-shape; a second elastic arm 24, which extends upward from the upper end of the first elastic arm 23 and then is curved forward and downward so as to have an inverted U-shape; and a contact bar 25 that connects to one side of the arm part of the second elastic arm 24, which extends forward and downward, and contacts with the connecting plate 30. The arm part of the second elastic arm, which extends forward and downward, is curved backward, so as to form a contact section 26. In this embodiment, the width of the switching spring 20 is set 0.6 mm, and the diameter of the counter pin 3 is set 0.3 mm.

On the other hand, the connecting plate 30, which is pressed in and secured onto the second insulating housing part 10B as described below, is comprised of a connecting section 31, which is connected and secured by soldering to the corresponding center conductor provided on the board 2, a press-in securing section 32 that connects to the connecting section 31 and is pressed in and secured to the corresponding press-in groove 11B (See FIGS. 9, 10 and 11) of the second insulating housing part 10B, and a contact bar 33 that extends upward from one side of the upper end of the press-in securing section 32. The contact bar 33 of the connecting plate 30 is generally flat, but has a contact section 34 that contacts with the protruded part of the contact bar 25 of the switching spring 20.

Detailed structures or functions of respective components will be described later, but referring now to FIGS. 4 and 5, the functions, operations, working principles and effects of the coaxial connector having a switch will be described. As shown in FIG. 4, when the counter pin 3 is not inserted in the hollow portion 12 of the insulating housing 10 through the opening 11, the protruded part of the contact bar 25 of the switching spring 20 is pressed to and contacted with the contact section 34 of the contact bar 33 of the connecting plate 30 by spring force generated by the first and the second elastic arms 23 and 24 of the switching spring 20. At this time, the center conductor arranged on the board 2 is electrically connected via the switching spring 20 and the connecting plate 30, and elements such as inner antenna, which are mounted on the board 2 related to the central conductor, are maintained active for their original purposes.

On the other hand, as shown in FIG. 5, when the counter pin 3 is inserted in the hollow portion 12 of the insulating housing 10 through the opening 11, the surrounding portion of the counter pin 3 presses down the contact section 26 of the switching spring 20 against the elastic displacing force generated by the first and the second elastic arms 23 and 24 of the switching spring 20. Accordingly, the protruded part of the contact bar 25 of the switching spring 20 is separated from the contact section 34 of the contact bar 33 of the connecting plate 30, and simultaneously the counter pin 3 is pressed by and contacted with the contact section 26 of the switching spring 20. At this time, the center conductor mounted on the board 2 is divided between the switching spring 20 and the connecting plate 30, but it is electrically connected to the counter pin 3 via the switching spring 20. Therefore, elements such as an antenna, which are mounted on the board 2 related to the center conductor, are switched from their original purposes, and made active for the device or elements such as outer antenna, which are related to the counter pin 3.

As in this embodiment, the switching spring 20 has a generally S-shape (more specifically, inverted S-shape) as a whole. Therefore, even if the height of the switching spring 20 is made smaller, and the height of the insulating housing 10, and therefore the height of the whole connector is made smaller, and the whole size of the connector can be made smaller, the switching spring 20 can have enough flexible spring characteristics. In addition, when the switching spring 20 is separated from the connecting plate 30 as shown in FIG. 5, the isolation distance D between the switching spring 20 and the connecting plate 30 can be set large. When the switching spring 20 is isolated from the connecting plate 30, and the counter pin 3 is contacted with the switching spring 20, the space between the switching spring 20 and the connecting plate 30 can be made large as a whole, so that the isolation characteristics of the coaxial connector 1, in which the counter pin 3 and the switching spring 20 work as the central conductors, can be improved. Since the distance between the connecting plate and the switching spring 20 can be set large at least in some area, isolation characteristics can be improved. Especially, if the counter pin 3 is inserted to the depth as illustrated in FIG. 5, the lower portion of the second elastic arm and the connecting plate 30 form generally inverted triangle space on the cross-sectional view, so that the isolation characteristics can be improved. Even if the counter pin 3 is inserted even deeper, such improvements can be still expected as long as the width of the counter pin is smaller than the switching spring, or as long as the pin is shaped rod-like if the diameter is large.

Figure 6:
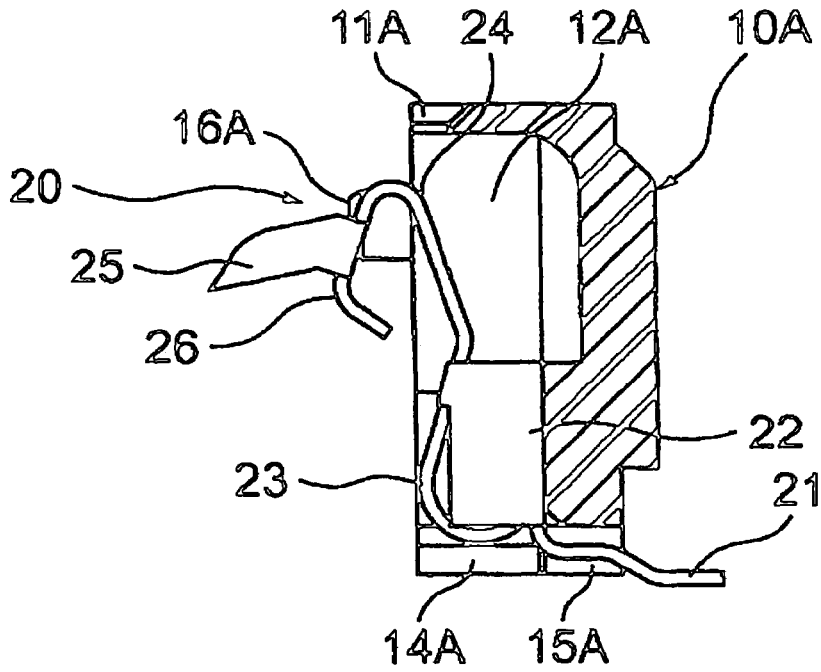
Figure 7:
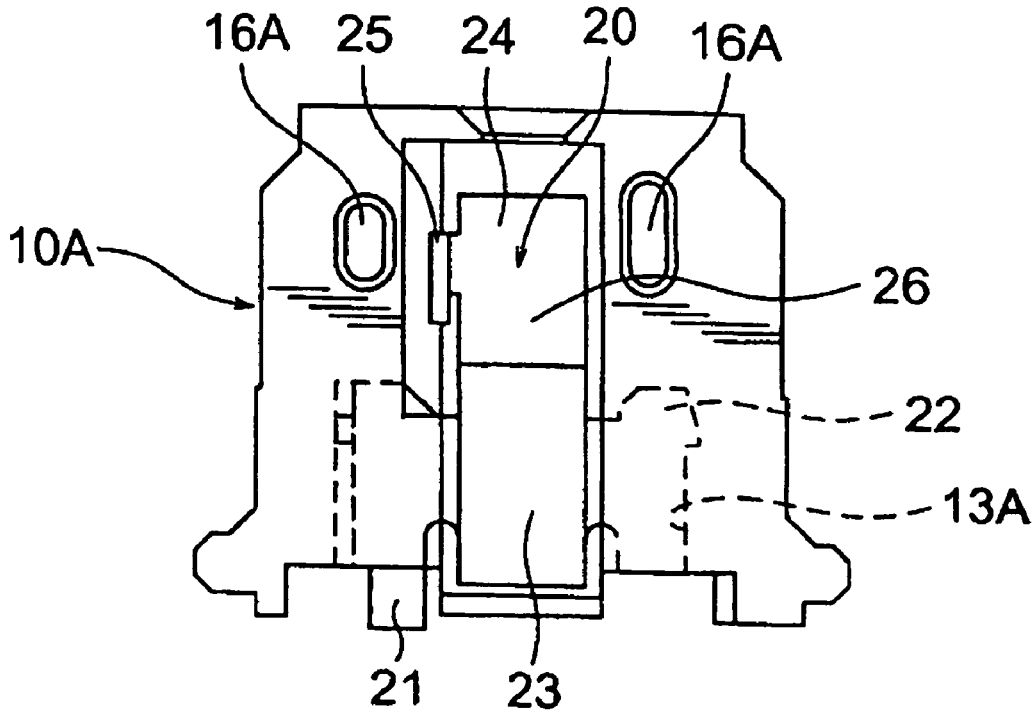
Figure 8:
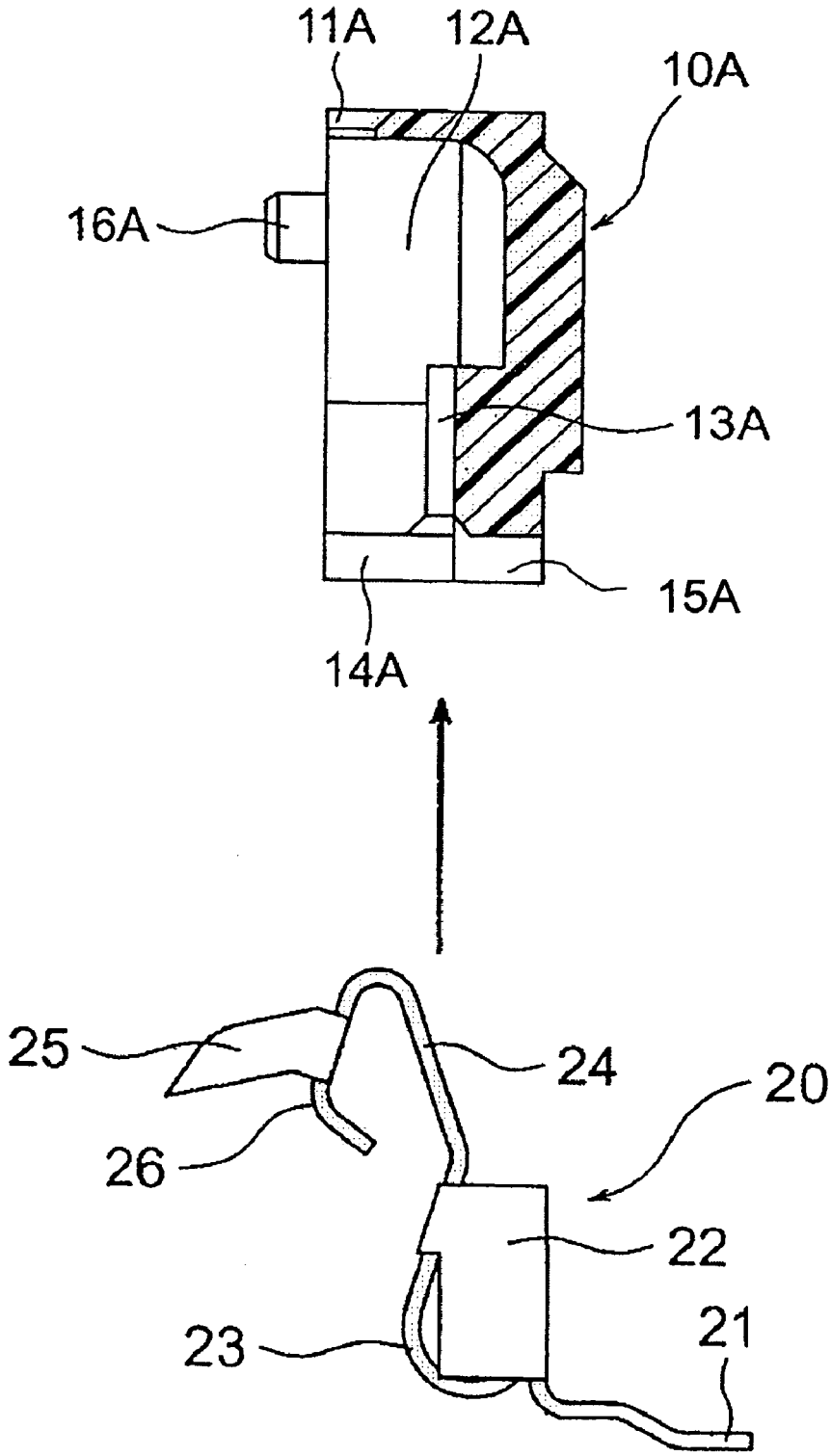

Referring now to FIGS. 6–8, detailed structure of the first insulating housing part 10A, detailed shape of the switching spring 20, and how to attach the switching spring 20 to the first insulating housing part 10A will be described below. FIG. 6 is an exploded cross-sectional view, in which the switching spring 20 is attached to the first insulating housing part 10A. FIG. 7 is a front view, in which the switching spring 20 is attached to the first insulating housing part 10A. As shown in those drawings, FIGS. 6–7, the first insulating housing part 10 has a semi-cylindrical shape as a whole, and has a semicircular beveled section 11A on the top so as to form the opening 11, and a concave portion 12A in the middle portion to form a hollow portion 12, when the first insulating housing part 10A is attached to the second insulating housing part 10B as described above. In addition, the first insulating housing part 10A has a press-in groove 13A at the inner wall near bottom to press the press-in securing section 22 of the switching spring 20. The bottom part of the first insulating housing part 10A has an open end 14A so as to be able to press the switching spring 20 into the press-in groove 13A. A pull-out concave section 15A is formed on the outer circumferential bottom surface of the first insulating housing part 10A to pull out the connecting section 21 of the switching spring 20. As fully illustrated in FIG. 7, the first insulating housing part 10 has an engaging convex section 16A on the upper portion on the contact surface, which contacts with the second insulating housing part 10B.

As fully illustrated in FIG. 7, the press-in securing section 22 of the switching spring 20, and the first and the second elastic arms 22 and 23 are arranged generally along the longitudinal center line of the first insulating housing part 10A. The contact bar 25 and the connecting section 21 are arranged off from the longitudinal center line. This arrangement of the contact bar 25 of the switching spring 20 off from the longitudinal center line, being combined with the arrangement of the contact bar 34 of the connecting plate 30 and so on off from the longitudinal center line, which will be described below, contributes to the improvement of the isolation characteristics at the time of switching the coaxial connector.

FIG. 8 illustrates the first insulating housing part 10A and the switching spring 20 before the switching spring 20 is attached in the first insulating housing part 10A. The press-in securing section 22 of the switching spring 20 is pressed in the press-in groove 13A of the first insulating housing part 10A in FIG. 8, and then the whole switching spring 20 is placed in the concave section 12A through the opened end 14A of the first insulating housing 10A, so that the switching spring 20 is attached to the first insulating housing part 10A. FIG. 6 shows that the switching spring 20 attached in the first insulating housing part 10A.

Figure 9:
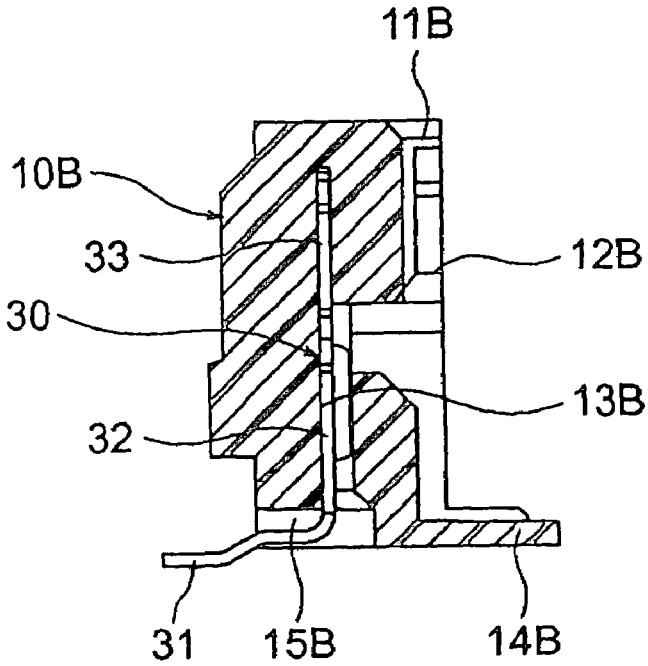
Figure 10:
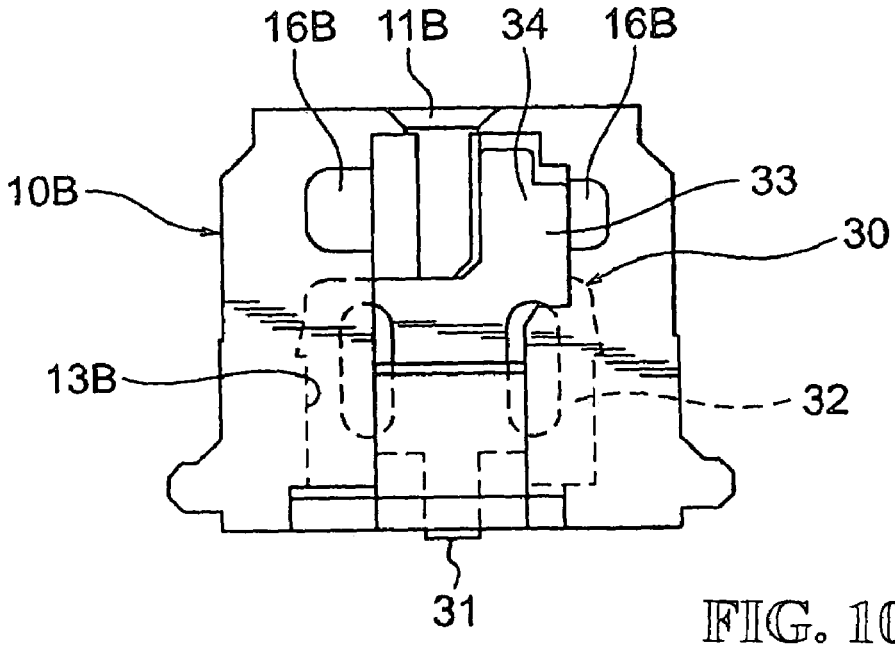
Figure 11:
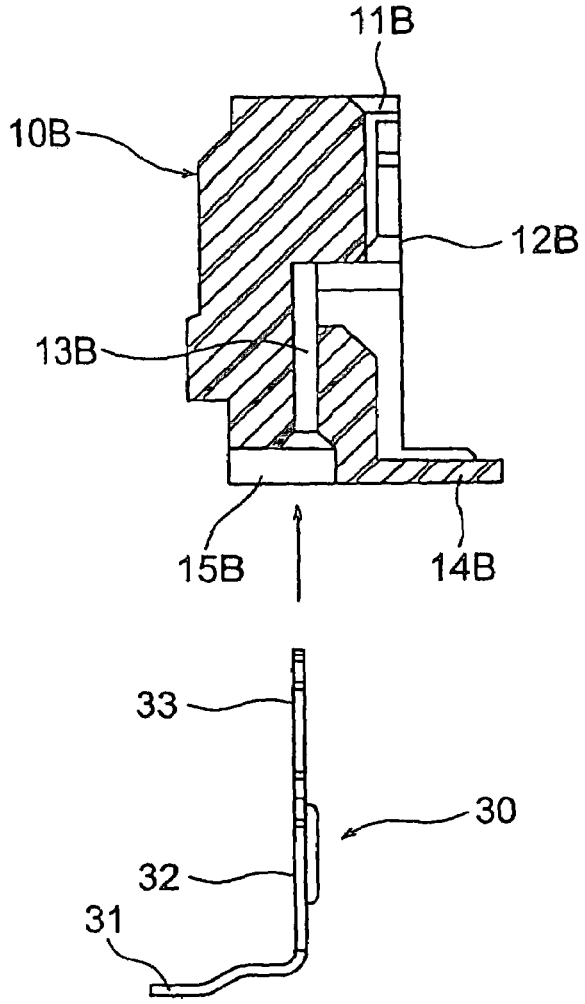

Referring now to FIGS. 9–11, detailed structure of the second insulating housing part 10B, detailed shape of the connecting plate 30, and the attachment of the connecting plate 30 to the second insulating housing part 10B are described below. FIG. 9 is an exploded cross-sectional view, which illustrates the attachment of the connecting plate 30 to the second insulating housing part 10B, and FIG. 10 is a front view, which illustrates the attachment of the connecting plate 30 to the second insulating housing part 10B. As shown in FIGS. 9 and 10, the second insulating housing part 10B has a semi-cylindrical shape as a whole, but as described above, the second insulating housing part 10B has a semicircular beveled section 11B on the top so as to form the opening 11, and has a concave section 12B in the middle portion so as to form the hollow portion 12, when the second insulating housing part 10B is attached to the first insulating housing part 10A. Furthermore, the second insulating housing part 10B has a press-in groove 13B for pressing the press-in securing section 32 of the connecting plate 30 in the inner wall near the bottom portion, and a lid 14B for closing the open end 14A when the second insulating housing part 10B is attached to the first insulating housing part 10A. A pull-out concave section 15B is formed on the outer circumferential bottom surface of the second insulating housing part 10B for pulling out the connecting section 31 of the connecting plate 30. Moreover, as fully illustrated in FIG. 10, the upper portion of the contact surface of the second insulating housing part 10B, which contacts with the first insulating housing part 10A, has an engaging concave section 16B. When the second insulating housing part 10B is attached to the first insulating housing part 10A, the engaging concave section 16B engages with the engaging convex section 16A so as to maintain the attachment.

In addition, as fully illustrated in FIG. 10, the press-in securing section 32 and the connecting section 31 of the connecting plate 30 are arranged generally along the longitudinal center line of the second insulating housing part 10B, but the contact bar 33 is arranged off the longitudinal center line and therefore away from the connecting section 26 of the switching spring 20. Such arrangement of the contact bar 33 of the connecting plate 30 and other elements off the center line, being combined with together with the arrangement of the contact bar 25 of the switching spring 20 and other elements off the longitudinal center line, which will be described below, contributes to the improvement of isolation characteristics at the time of switching the coaxial connector.

FIG. 11 illustrates that the second insulating housing part 10B and the connecting plate 30 face each other. In FIG. 11, the press-in securing section 32 of the connecting plate 30 is pressed in the press-in groove 13B of the second insulating housing, and the whole connecting plate 30 is placed in the concave section 12B through the bottom portion of the second insulating housing part 10B, so that the connecting plate 30 is attached to the second insulating housing part 10B. FIG. 9 illustrate the attachment made as described above.

As shown in FIG. 6, assembly of the coaxial connector 1 having a switch according to this embodiment is done by first attaching the switching spring 20 to the first insulating housing part 10A by pressing therein as shown in FIG. 6, and attaching the connecting plate 30 to the second insulating housing part 10B by pressing in. Then, the first insulating housing part 10A and the second insulating housing part 10B are attached to each other by fitting the engaging convex sections 16A of the first insulating housing part 10A to the corresponding engaging concave sections 16B of the second insulating housing part 10B. Lastly, the metallic case 40 is applied from the top portion of the insulating housing 10 so as to surround the outer circumferential portion of the insulating housing 10 comprised of the first insulating housing 10A and the second insulating housing part 10B, which are attached as described above. At this time, the bottom portion of the hollow portion 12, which is formed inside of the insulating housing 10 is closed with the lid 14B of the second insulating housing part 10B, so as to prevent dust from entering the hollow portion 12. FIGS. 1, 2, 4 and 5 show the coaxial connector assembled in this way.

Detailed structure of the metallic case 40 in this embodiment will be now described. As fully shown in the perspective views of FIGS. 1 and 2, the metallic case 40 in this embodiment has an upper surrounding part 41 that has a cylindrical shape as a whole, and a lower connecting part 42 that is connected to the upper surrounding part 41 and has a rectangular shape as a whole. The upper surrounding part 41 has a shape so as to surround the outer circumferential portion of the insulating housing 10, and has an opening 41A on the top so as not to close the opening 11 of the insulating housing 10. On the other hand, the lower connecting part 42 is formed larger than the bottom surface area of the insulating housing. A brim 42B, which will be described later, is formed in the extending directions of the connecting sections 21 and 31 to the center conductor, and made longer than in the direction perpendicular to the extending directions. By bending the lower connecting part 42 to form generally squared U-shapes so as to surround the insulating housing, the insulating housing can be held, and the connecting legs 42A that are to be connected to an outer conductor or ground conductor or other elements, which is mounted on the board, by soldering, are formed. Accordingly, the brim 42B is provided between the connecting legs 42A, i.e. in the extending directions of the connecting sections 21 and 31 to the center conductor, being separated from those connecting sections. As for the ways of making the brim, the insulating housing can have longer sides and shorter sides, and the metallic case can be square.

As fully shown in FIG. 4, the brim 42B provided on the metallic case 40 covers the connecting section of the switching spring 20 and the connecting section 31 of the connecting plate 30, which are connected to the center conductor on the board 2 when the coaxial connector 1 having a switch is mounted on the board 2. Effects of making such brim 42B will now be described below. The foot patterns of the mounted portions of the board is usually set narrower than the transmission line (Since there are grounds on both sides and the size is small, the center terminal has to be narrow). For this reason, it can be considered that the impedance becomes dramatically high and the reflex characteristics become poor. However, by covering the mounted portions with the brim 42B of the metallic case 40, it can prevent the impedance from becoming extremely high, and the reflex characteristics can be improved. In addition, the thinly extending connecting sections 21 and 31 can be protected.

Figure 12:
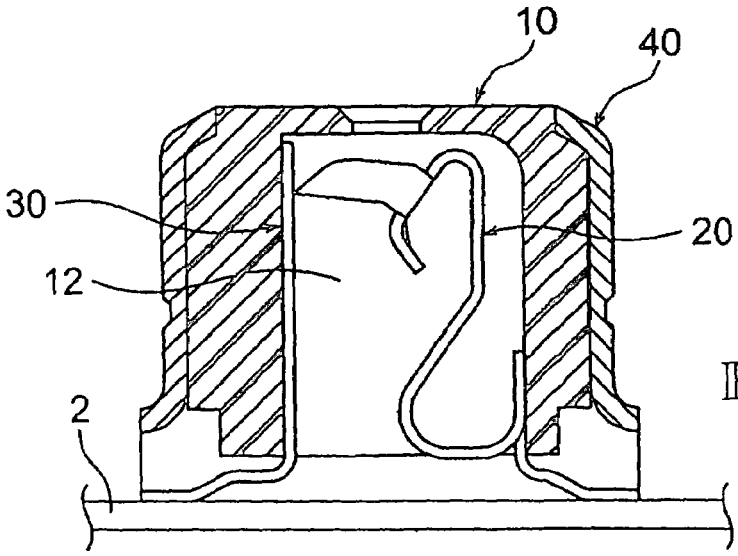
FIG. 12 is an exploded cross-sectional view of the coaxial connector having a switch according to another embodiment of this invention, which is similarly illustrated to FIG. 4.

FIG. 12 is an exploded cross-sectional view of the coaxial connector having a switch according to another embodiment of this invention, which is similarly illustrated to FIG. 4. In the embodiment described above, the insulating housing is formed by attaching two separate insulating housing parts, the first and the second insulating housing parts. In the embodiment of FIG. 12, the insulating housing is not divided into two parts, but formed as a one-piece insulating housing. By forming the insulating housing as a one piece, the switching spring 20 and the connecting plate 30 can be easily pressed in the insulating housing 10, so that the bottom portion of the hollow portion of the insulating housing 10 is open. The other structures than described above are similar, so that same reference numerals as in FIG. 4 are used for the reference numerals of corresponding elements in FIG. 12, and the explanation will be omitted.

Figure 13:
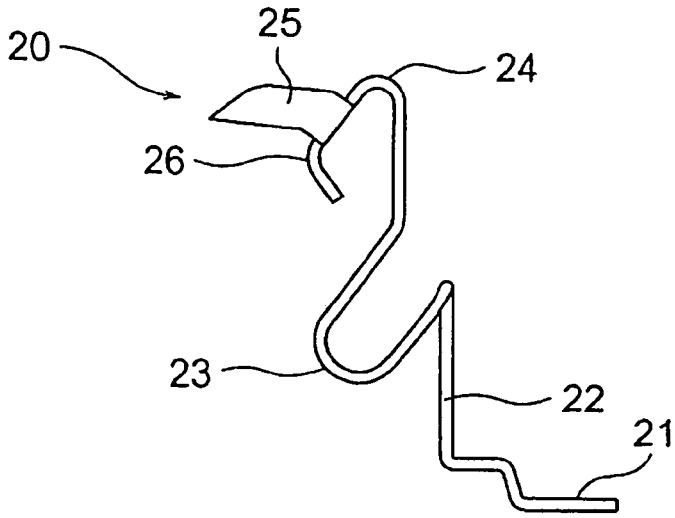
FIG. 13 shows another embodiment of the switching spring in the coaxial connector having a switch of this invention.

FIG. 13 illustrates an example of another embodiment of the switching spring 20. While the first elastic arm 23 of the switching spring 20 in the above-described embodiment extends from the lower end (one end near the board 2) of the press-in securing section 22, the first elastic arm 23 in the switching spring 20 of FIG. 13 extends from the upper end (the other end opposite to the board 2) of the press-in securing section 22.

Figure 14:
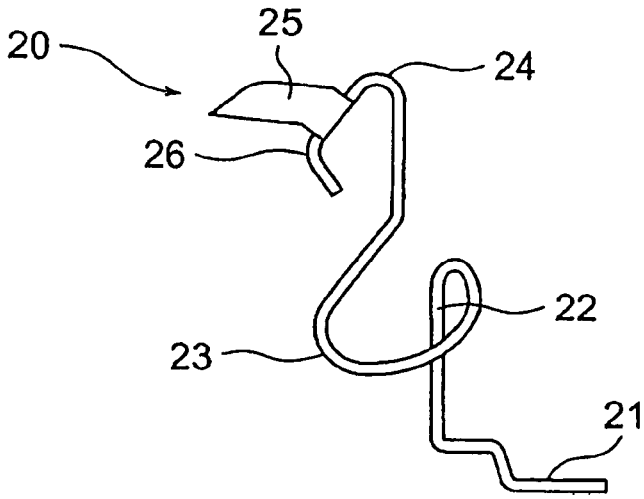
FIG. 14 shows still another embodiment of the switching spring in the coaxial connector having a switch.

FIG. 14 shows an example of still another embodiment of the switching spring 20. While the first elastic arm 23 of the switching spring 20 extends downward and forward from the lower end of the press-in securing section 22 in the previously described embodiment, the first elastic arm 23 of this switching spring 20 in FIG. 14 extends downward and backward from the upper end of the press-in securing section 22 and then is curved forward and upward. In addition, while the contact bar 25 is provided on the switching spring 20 in the above-described embodiment, the contact bar 25 can be provided on the connecting plate 30 as a yet another embodiment, instead of providing on the switching spring 20.

According to this invention, the isolation characteristics of the coaxial connector having a switch at the time of switching can be improved. Also, the space can be saved and the length of the spring can be set long, so that the size of the connector can be even more reduced. By altering the structure of the metallic case, the reflex characteristics on the mounted portion can be improved. According to the above-described effects, the coaxial connector having a switch according to this invention is highly useful for industrial application.

The invention claimed is:

1. A coaxial connector having a switch, comprising:

an insulating housing, which has an opening and a hollow portion to receive a counter pin;

a switching mechanism, which is comprised of a pair of switching means, which is disposed in said insulating housing and can work as a center conductor according to the operation with said counter pin; and an outer conductor, which is provided so as to surround an outer perimeter of said insulating housing, wherein said pair of switching means is comprised of a switching spring and a connecting plate, which extend as a whole along the direction of inserting/removing said counter pin into/from said opening and said hollow portion and have shapes so as to face each other in said hollow portion, said switching spring is comprised of:

a securing section for securing to said insulating housing; and a generally S-shaped elastic arm, which is comprised of a generally U-shaped first elastic arm that extends from said securing section into said hollow portion, and a generally inverted-U-shaped second elastic arm that extends from said first elastic arm, and said second elastic arm has:

a contact section for contacting with said connecting plate when said counter pin is not inserted into said hollow portion; and another contact section for contacting with said counter pin when said counter pin is inserted in said hollow portion.

2. The coaxial connector having a switch according to claim 1, wherein said first elastic arm extends from a part of said securing section, which is near a mounting board.

3. The coaxial connector having a switch according to claim 1, wherein said first elastic arm extends from a part of said securing section, which is near a mounting board.

4. The coaxial connector having a switch according to claim 1, wherein said connecting plate is generally flat, and has a contact section for contacting with said switching spring, said contact section of said connecting plate being arranged off in relative to an arrangement of said securing section.

5. The coaxial connector having a switch according to claim 1, wherein said outer conductor is comprised of a metallic case, which has:

an upper surrounding part for surrounding said insulating housing; and a lower connecting part, which is connected to said upper surrounding part, and has a brim, which covers said securing section of said switching spring and a connecting section of said connecting plate, which connect with a center conductor of said board.

6. The coaxial connector having a switch according to claim 1, wherein said insulating housing is formed as a one-piece component.

7. The coaxial connector having a switch according to claim 1, wherein said insulating housing is divided into two parts, a first insulating housing part and a second insulating part, and is formed by attaching said first and said second insulating housing parts to each other.

8. A coaxial connector having a switch, comprising:

an insulating housing, which has an opening and a hollow portion to receive a counter pin;

a switching mechanism, which is comprised of a pair of switching means, which is disposed in said insulating housing and can work as a center conductor according to the operation with said counter pin; and an outer conductor, which is provided so as to surround the outer perimeter of said insulating housing, wherein said pair of switching means is comprised of a switching spring and a connecting plate, which extend as a whole along the direction of inserting/removing said counter pin into/from said opening and said hollow portion and have shapes so as to face each other in said hollow portion, said switching spring is comprised of:

a securing section for securing to said insulating housing; and an elastic arm, which extends from said securing section into said hollow portion and has:

a contact section for contacting with said connecting plate when said counter pin is not inserted into said hollow portion; and another contact section for contacting with said counter pin when said counter pin is inserted in said hollow portion, and said outer conductor is comprised of a metallic case which has:

an upper surrounding part for surrounding said insulating housing; and a lower connecting part, which is connected to said upper surrounding part and has a brim, which projects from said insulating housing in an extended direction of said securing section of said switching spring and a connecting section of said connecting plate, which connect with a center conductor of said board, to define hollow spaces in which said sections of said switching spring and connecting plate are disposed.

9. The coaxial connector having a switch according to claim 8, wherein said lower connecting part of said outer conductor has a U-shaped connecting leg which extends in said extending directions of said connecting sections.

* * * * *